United States Patent [19]

Rubbo et al.

[11] Patent Number: 4,949,792

[45] Date of Patent: Aug. 21, 1990

[54] PACKER ASSEMBLY AND MEANS FOR ACTIVATING SAME ONLY IN SMALLER DIAMETER WELL CONDUIT

[75] Inventors: Richard P. Rubbo; Alfred R. Curington, both of The Woodlands, Tex.

[73] Assignee: Baker Hughes Incorporated, Houston, Tex.

[21] Appl. No.: 345,206

[22] Filed: Apr. 28, 1989

[51] Int. Cl.[5] ..... E21B 23/06; E21B 33/128

[52] U.S. Cl. ..... 166/382; 166/387; 166/240; 166/118; 166/134

[58] Field of Search ..... 166/382, 387, 118, 134, 166/138, 206, 209, 216, 217, 240, 237

[56] References Cited

U.S. PATENT DOCUMENTS

| | | | |
|---|---|---|---|
| 2,906,347 | 9/1959 | Baker | 166/237 |
| 3,115,189 | 12/1963 | Althouse, Jr. et al. | 166/240 |
| 3,412,790 | 11/1968 | Brown | 166/240 |
| 3,502,144 | 3/1970 | Young | 166/216 |
| 3,603,388 | 9/1971 | Current et al. | 166/240 |
| 3,746,090 | 7/1973 | Read et al. | 166/240 |
| 4,106,565 | 8/1978 | Braddick | 166/118 |
| 4,537,251 | 8/1985 | Braddick | 166/118 |
| 4,545,431 | 10/1985 | Fore | 166/240 |

*Primary Examiner*—Bruce M. Kisliuk

*Attorney, Agent, or Firm*—Hubbard, Thurman, Turner, Tucker

[57] ABSTRACT

A packer assembly is provided for use in a subterranean well and settable only by longitudinal manipulation of a tubular workstring. The assembly has an outer housing and a seal assembly with anchoring slips carried by the housing in retracted position and movable to expanded position along the wall of a casing or the like. A longitudinally extending central mandrel telescopes within the housing. Orienting and setting pins are provided for initial receipt within orienting and setting slots with the setting pins being moved to the orienting slot to permit setting of the packer. The seal assembly and anchoring slips are maintained in retracted position and are responsive to a variation in internal diameter between a first and second tubular conduit to thereafter permit the manipulating device to move the seal assembly and the anchoring slips to expanded position within only the second tubular conduit which has a diameter less than that of the first tubular conduit.

28 Claims, 9 Drawing Sheets

PACKER ASSEMBLY AND MEANS FOR ACTIVATING SAME ONLY IN SMALLER DIAMETER WELL CONDUIT

BACKGROUND OF THE INVENTION

(1) FIELD OF THE INVENTION:

The invention pertains to a packer assembly for use in a subterranean well.

(2) BRIEF DESCRIPTION OF THE PRIOR ART:

Subsequent to the drilling of a subterranean oil or gas well, a string of tubular conduit commonly referred to as "casing" is run into the well. Thereafter, the casing is cemented into place. After the cementing operation, it is necessary to perforate the well so that production fluids within the production zone may flow from the production zone, through holes perforated through the cement behind the casing, into holes in the casing, and through the well bore to the top of the well.

For many years the desirability of utilizing a subterranean wellbore having a non-vertical or horizontal portion traversing a production formation has been known and appreciated in the art. Laterally directed bores are drilled radially, usually horizontally from the primary vertical wellbore, in order to increase contact with the production formation.

Most production formations have a substantial horizontal portion and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be re-drilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In U.S. Pat. No. 3,101,783, entitled "Well Packer", issued Aug. 27, 1963, there is shown and disclosed a single grip retrievable casing packer which is manipulable between run-in and set positions by longitudinal manipulation of the tubular workstring. A similar device is disclosed in U.S. Pat. No. 3,112,795, entitled "Retrievable Subsurface Well Tool", issued Dec. 3, 1963, and discloses a patentable variation of the '783 device and includes what is commonly referred to as a "hold-down buttons" which temporarily secure the packer to the casing upon variation in tubing/casing pressure, such as when tools either above or below the packer are being activated from one position to another position, and it is desired to temporarily secure the packer in position, or to act as a securing "boost" against movement of the packer in one longitudinal direction either prior to or during setting along the inner wall of the casing. While each of these patented designs can be considered advancements in the art, neither is adapted to be activated from the running position to the set position in only one diameter of casing. In other words, these and similar tools could be inadvertently set at a depth somewhat above the desired setting depth in the subterranean well. Additionally, such packers can require rotational movement of the tubular workstring to either set or retrieve the packers, and such rotational movement is difficult in deviated wells associated with horizontal completion techniques. Accordingly, in such completion techniques, it will become difficult, if not almost impossible, to apply sufficient torque at the top of the well to manipulate the tubular workstring when it has been run in such a well through the deviated section and curved portion of the well to the horizontal section adjacent the production zone. In such instances, it would be desirable to provide a retrievable packer which is manipulable from run-in to set and retrieved position only by longitudinal manipulation, i.e., push/pull of the workstring.

In such horizontal completions, as well as many other types of completions, it is not infrequent that a "liner" of smaller diameter casing is run into the larger casing size and hung therefrom such that an expanded telescopic configuration of the casing occurs. In such instances, the retrievable packer apparatus must not be inadvertently activated in the larger diameter casing such that it is placed in the "set" position prematurely.

In one aspect of the present invention, a retrievable packer is provided having particular utility for use in horizontal completion operations, with the packer being manipulated between run-in, set and retrieving positions only by longitudinal movement of the workstring.

Another aspect of the present invention is the provision of a packer assembly which is retained in the run-in position and prevented from inadvertent manipulation to the set position until such time as the device parallels a known size of casing, or other conduit, through which it is disposed.

SUMMARY OF THE INVENTION

A packer assembly is provided for use in a subterranean well and settable only by longitudinal manipulation of a tubular workstring. The assembly has an outer housing and a seal assembly and anchoring means carried by the housing in retracted position and movable to expanded position along the wall of a casing or the like. A longitudinally extending central mandrel telescopes within the housing. Orienting and setting pins are provided for initial receipt within orienting and setting slots with the setting pins being moved to the orienting slot to permit setting of the packer. Means are also provided for maintaining the seal assembly and the anchoring means in retracted position and responsive to a variation in internal diameter between a first and second tubular conduit to thereafter permit the manipulating means to move the seal assembly and the anchoring means to expanded position within only the second tubular conduit which has a diameter less than that of a first tubular conduit.

DESCRIPTION OF THE PREFERRED EMBODIMENTS

Figure 1:
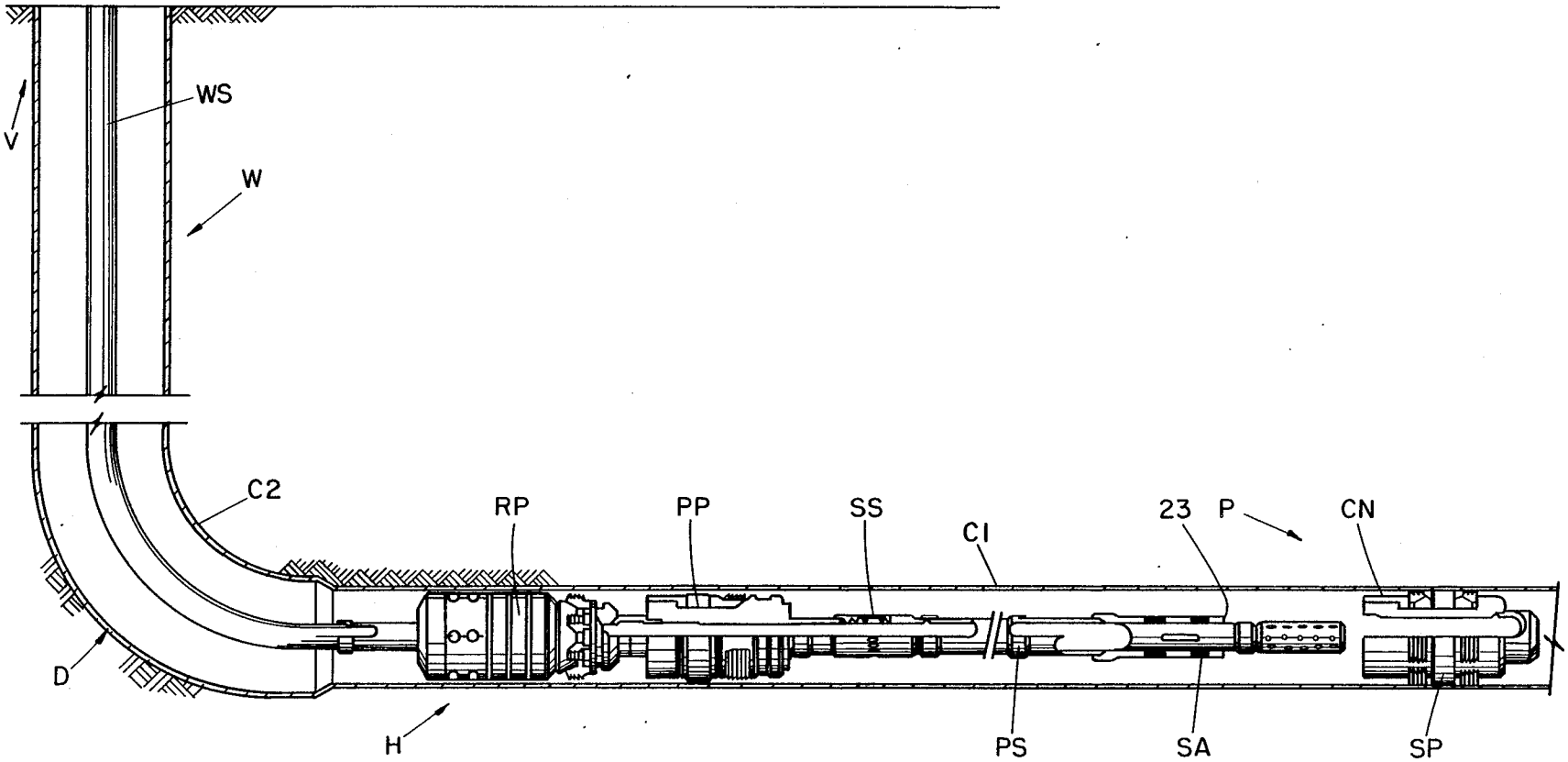
FIG. 1 is a schematic illustration of a subterranean well incorporating the apparatus of the present invention on a workstring in a horizontal section of a deviated well, and within a casing liner having an internal diameter smaller than that of the initially run casing thereabove.
Figure 2A:
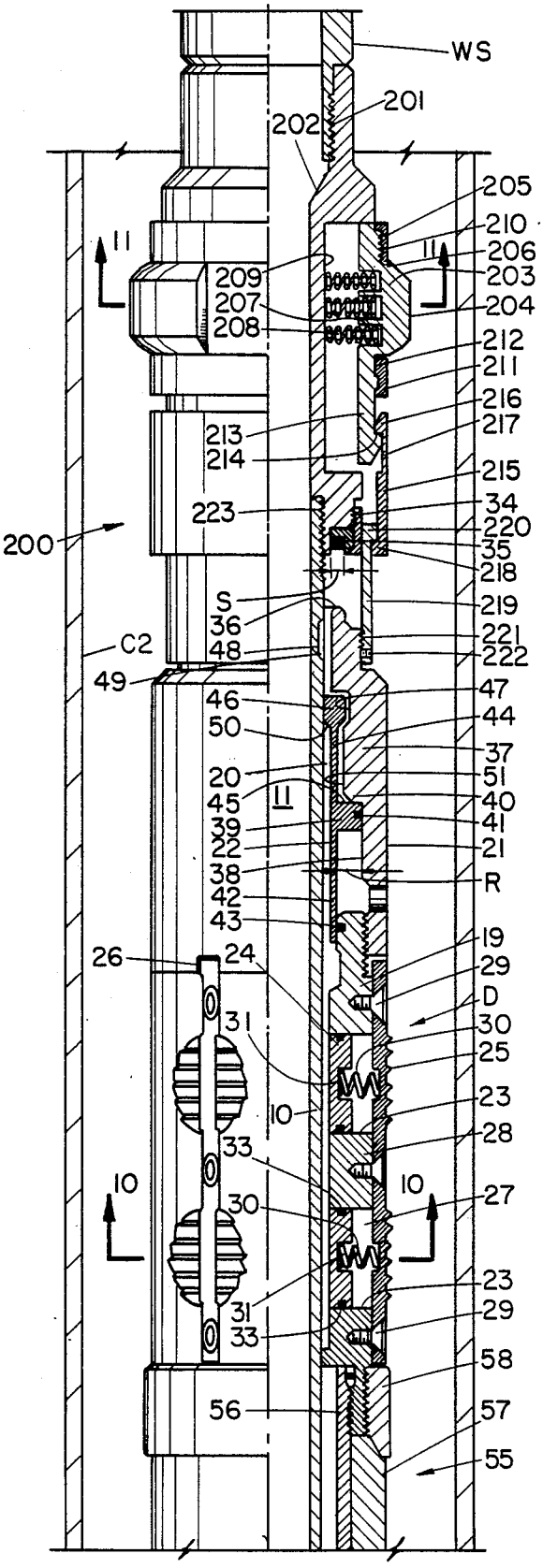
FIGS. 2A and 2B together constitute a combined side elevational and longitudinal sectional view through the apparatus embodying the invention, with the device in condition for moving the tool longitudinally through a well casing, FIG. 2B constituting a lower continuation of FIG. 2A.
Figure 2B:
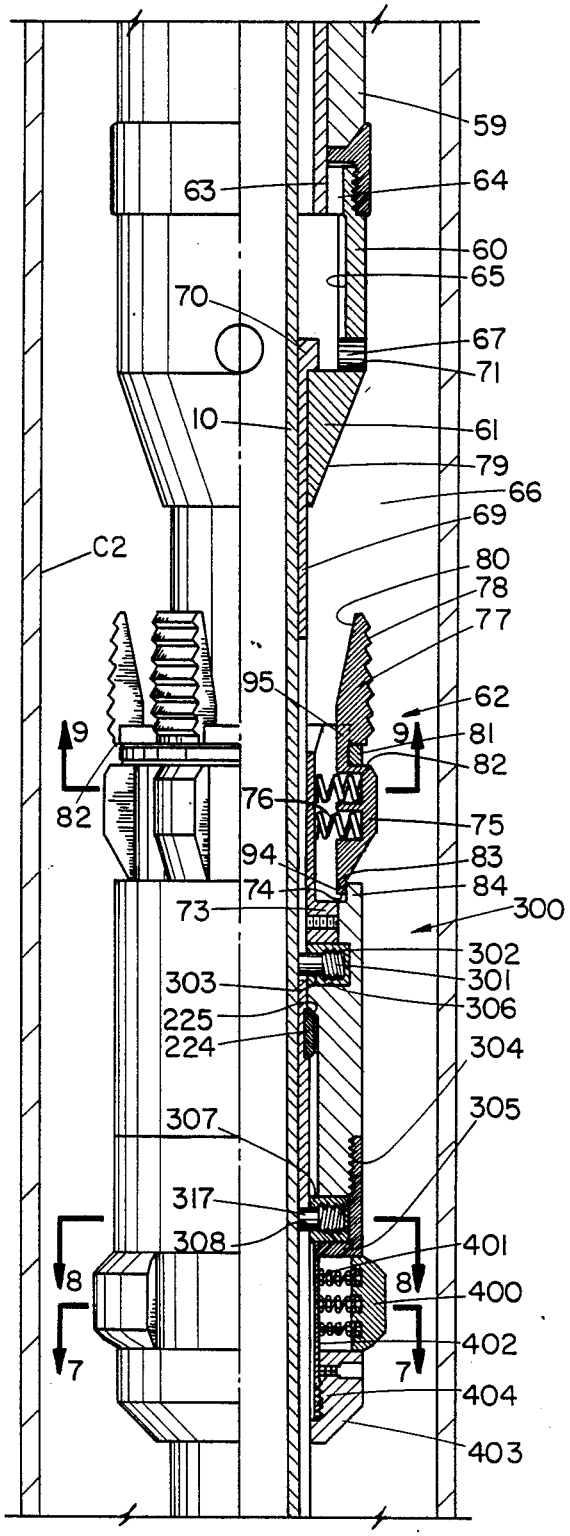
Figure 3:
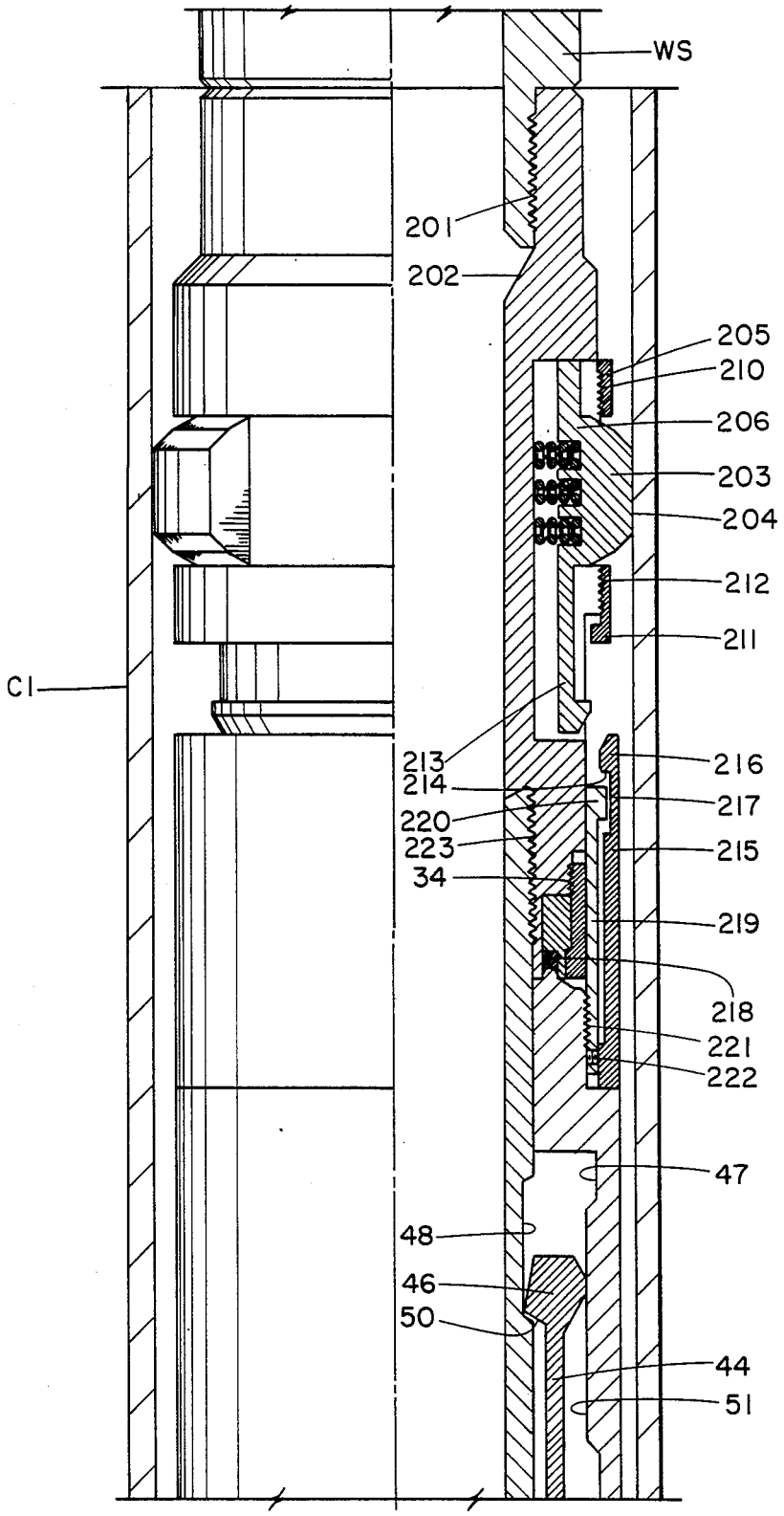
FIG. 3 is a view of the upper portion of the tool in the casing liner with the retraction maintenance means separated.

With reference to FIG. 1, there is shown a subterranean well W having a first vertical section V communicating with the top of the well W and extending into a deviation or curvature thereof D which, in turn, extends into a horizontal section H traversing a production zone P.

Prior to running the well packer RP into the well on a workstring WS also carrying a permanent packer PP, the casing C has been placed into the well and cemented therein. The casing C, which has a smaller diameter liner section C-1 has been placed into the well and cemented therein. The casing liner C-1 will have perforations therethrough subsequent to the firing of a perforating gun (not shown).

The retrievable well packer RP is adapted to be anchored to the casing liner C-1 against movement in both an upward and downward direction, and to packed-off condition against the wall of a well casing to prevent leakage of fluid thereby. The lowermost portion of the tool is a set-down type of well packer, the upper portion D of the tool being constituted as an anchor to prevent upward movement of the apparatus in the well casing C-1.

The well packer RP is lowered in the well casing on the tubular workstring WS extending to the top of the well W, and through which fluent substances under pressure, such as cement slurry, acid, and the like, can be pumped, flowing through the central passage of the tool for discharge from its lower portion.

The well packer RP includes a central main body or mandrel 10 having a passage 11 therethrough that may be of relatively large diameter. The upper portion of this body is threadably secured to a top body sub 202 by means of threads 223. The mandrel 10 extends downwardly through the entire length of the well packer RP and has a lower threaded pin 15 for threaded attachment to a lower section of tubing or a lower tool F.

The upper portion D of the tool includes an anchor body 19 surrounding the mandrel 10, and which may be laterally spaced therefrom to provide an annular space 20 therebetween. This annular space 20 extends upwardly through a housing 21 for a control valve and a balance sleeve 22, the lower end of the housing 21 being threadably attached to the upper end of the anchor body 19.

The anchor body has a plurality of circumferentially spaced cylindrical bores 23 therethrough, each containing a piston gripping element 24 slidably radially therein. Each cylindrical bore 23 is open to the interior of the anchor body 19 and also to the exterior thereof. The piston gripping elements 24 have external wickers or teeth 25 that may face in an upward direction to anchor the well packer RP to the well casing C-1 against upward movement therewithin.

As shown, a plurality of cylinders 23 and gripping elements 24 are provided in longitudinal alignment with one another, there being sets of such longitudinally aligned gripping elements 24 disposed around the circumference of the anchor body 19.

The anchor body has external grooves 26 on opposite sides of aligned cylinders in each set, these grooves merging into companion grooves 27 formed in the outer portions of the longitudinally aligned gripping elements 24. Disposed in the body and gripping element grooves are retainer members and spring seats 28 in the form of bars suitably secured to the anchor body, as by use of screws 29. Each bar retains the piston gripping elements 24 properly oriented with their wickers or teeth 25 facing in an upward direction. Each bar also serves as the outer spring seat for a helical compression spring 30 disposed in and bearing against the socket portion 31 of each pistion gripping element 24, tending to urge each piston gripping element inwardly to its fullest extent, but yieldably permitting its inward and outward radial movement.

The piston gripping elements 24 are expanded outwardly whenever fluid pressure differential, sufficient to overcome the compressive force of the springs 30, is present interiorly of the body 19. In the present case, such fluid pressure is derived from the exterior of the tool below the anchor portion D of the apparatus, which pressure can pass through the annular space 20 between the body or mandrel 10 of the tool and the anchor body 19 to each of the cylinders 23. The fluid pressure differential for expanding the gripping elements is actually derived from a location in the well casing C-1 below the set down type of well packer portion of the tool, passing from such location into the annular space 20 through a path described hereinbelow. Fluid pressure in the cylinders 23 urges each piston 24 outwardly, leakage of fluid along each piston being prevented by a suitable piston ring or side seal ring 33 in the piston slidably sealing against the wall of its companion cylinder 23.

The inner mandrel or body 10 is shiftable longitudinally with respect to the anchor body 19 and the housing 21 secured thereto to open and close the annular passage 20. Thus, the mandrel carries the valve head 34 threadably attached to the top or body sub 202, which has a suitable peripheral seal ring 35 thereon, the head and seal ring being adapted to move downwardly within a cylindrical seat 36 formed in the valve head portion 37 of the housing 21. When the mandrel 10 is shifted downwardly relative to the anchor body 19 and the housing 21, its valve head 34 and seal ring 35 are moved within the cylindrical seat 36 such that the elastomer seat 35 is snugly secured against the uppermost end 36 of the valve head portion 37, closing the upper portion of the annular passage 20 and enabling the pressure below the tool and tending to elevate the mandrel 10 to be counter balanced, so as to prevent inadvertent opening of the valve device. The annular balancing sleeve 22 is disposed in an annular cylinder portion 38 of the housing 21. This sleeve or piston 22 includes a head 39 initially occupying an upward position adjacent to a cylinder head 40, the piston head 39 being slidable along the wall of the cylinder 38. Leakage of fluid between the piston and cylinder is prevented by a suitable piston ring 41 carried by the piston and slidably sealing against the wall of the cylinder 38. The piston has a skirt 42 depending from its head 39, which is slidable along and within the upper portion of the anchor body 19, leakage of fluid therebetween being prevented by suitable side seal 43 mounted in the anchor body and slidably sealing against the outer periphery of the skirt 42. The piston device 22 has an internal diameter substantially greater than the external diameter of the body or mandrel 10, so as not to obstruct the annular passage 20 between the body 10 of the tool and the housing 21 and anchor body 19 surrounding the body 10.

Integral with the balancing member 22 are upwardly extending arms 44 formed by providing circumferentially spaced longitudinal slots 45 in an upper portion of the balance member, these arms terminating in upper fingers or heads 46 initially disposed in an internal groove 47 in the housing 21, the heads 46 tending to spring inwardly and initially engaging the periphery of the tool body. When the mandrel 10 is moved downwardly within the anchor body 19 and housing 21, to dispose the valve head 34 and seal 35 within the valve seat 36, and thereby close the valve portion of the device, a peripheral groove 48 in the mandrel 10 below the valve head 34 is located opposite the fingers or heads 46, such fingers or heads then springing inwardly within such groove 48 and out of the internal circumferential groove 47 in the valve head. Any pressure in the closed annular passage 20 will now act in a downward direction on the piston head 39, such downward force being transmitted through the fingers 46 to the lower side 49 of the mandrel groove 48, thereby tending to urge the body or mandrel 10 in a downward direction. The lower side 49 of the mandrel groove and the lower inner portions 50 of the fingers or heads are inclined in an inward and upward direction, so that upward movement of the mandrel 10 relative to the fingers or heads will cam the latter outwardly when they are disposed opposite the internal housing groove 47. When the fingers or heads are disposed in the mandrel groove 48, they are out of the housing groove 47 and are free to move into the lower smaller diameter portion 51 of the housing 21, the balance device 22 then being free from the housing 21 and capable of exerting a downward force on the body or mandrel 10.

The fluid pressure within the well packer RP when in its set condition tends to act in an upward direction over the cross-sectional area of the body 10 and its valve head 34, designated by the letter S, tending to shift the mandrel 10 in an upward direction with respect to the valve seat 36, which would effect opening of the valve. Such upward movement is counter balanced, in the present instance, by making the annular area R of the balance pistion 39 substantially equal to the area S. The fluid pressure within the tool is acting in a downward direction on the piston over the area R and such downward force is transmitted through the latch fingers or heads 46 to the mandrel 10. Thus, substantially equal and opposite forces are being exerted by the fluid pressure on the body or mandrel 10, precluding its inadvertent shifting under the action of fluid pressure to a valve opening condition. If desired, the area R can be made slightly greater than the area S so that the fluid pressure is actually tending to maintain the body or mandrel 10 in a downward direction to insure against inadvertent opening of the valve device and the annular passage.

The valve device can readily be shifted to an open condition merely by elevating the tubular string WS, which will shift the body or mandrel 10 upwardly with respect to the anchor body 19 and the housing 21. There is very little, if any, resistance by fluid pressure to such upward movement of the mandrel, in view of the balancing action of the fluid pressure acting in an upward direction over the area S and in a downward direction over the area R. Accordingly, the mandrel 10 and the balance sleeve 22 latched thereto are moved upwardly until the fingers 46 are disposed opposite the circumferential groove 47 in the housing 21, whereupon the lower shoulder or side 49 of the mandrel groove can cam the fingers outwardly into the housing groove 47, the fingers thereby being free to the mandrel groove 48 to allow the mandrel 10 to move upwardly to its fullest extent, free from restraint by the fingers 46.

The upper anchor portion D of the apparatus is secured to the downwardly acting set down type of well packer RP. This packer includes a normally retracted packing device 55 surrounding the tubular body or mandrel 10, which includes an inner support sleeve 56 threadably attached to the lower end of the anchor body 19 and the spaced laterally from the body to provide a continuation to the annular passage 20 through which fluid can pass. Surrounding the support sleeve is a packing structure 57, such as a rubber or rubber-like elastomeric packing sleeve, which is normally retracted. The upper end of the packing structure 57 is adapted to engage the lower end of the anchor body 19, which serves as an upper abutment. It also engages an upper gauge ring 58 threaded on the lower end of the anchor body 19, and serving as an outer extension of the upper abutment. The lower end of the packing sleeve 57 is engagable with a lower abutment 59 slidable on the support sleeve 56 and threadably connected to an expander sleeve portion or sleeve extension 60, which is integral with a lower expander 61 of generally frustoconical shape adapted to coact with a plurality of circumferentially spaced lower slips 62 for anchoring the apparatus in the well casing liner C-1.

When the packing structure 57 is in relaxed position, the lower abutment 59 may engage an external lower flange 63 of the support sleeve 56. The support sleeve and the expander sleeve portion 60 may be non-rotatably secured to one another, while permitting their relative telescopic movement, by attaching a key 64 to the flange portion of the upper sleeve which is slidable in a longitudinal key way or slot 65 in the interior of the expander sleeve 60.

Fluid can pass through the annular space 66 surrounding the apparatus and around the expander 61, flowing inwardly through a plurality of circumferentially spaced ports or openings 67 in the expander sleeve portion 60 to its interior and then flowing upwardly through the annular passage 20, discharging through the valve seat 36 and into the annulus 66 around the body 10 and the tubular workstring WS. Downward movement of the tubular workstring WS and body 10 relative to the members surrounding the body will, as has been described above, place the valve head 34 in engagement in the valve seat 36 to close the annular passage 20 around the body.

A connector sleeve 69 is slidably mounted on the exterior of the body 10, its upper portion extending within the expander 61 and terminating in an upper stop or flange 70 that projects outwardly and is adapted to engage the upper end 71 of the expander. The lower end of the connector sleeve 69 may rest upon the upper end of a setting pin 317.

Surrounding the connector sleeve 69 is a slip sleeve 73 slidable thereon and having a plurality of longitudinally extending circumferentially spaced grooves 74 in which the slips 62 are laterally movable. These slips each include a lower drag portion 75 adapted to frictionally engage the inner wall of the well casing liner C-1, and are urged outwardly thereaginst by one or a plurality of compression springs 76 engaging the basis of the grooves 74 and the drag portion 75 of the slips. The slips 62 include upper anchor portions 77 having downwardly facing wickers or teeth 78 adapted to engage and embed themselves in the wall of the well casing liner C-1, to prevent downward movement of the slips therealong when expanded outwardly by the expander 61. The expander 61 has a downward and inwardly inclined tapered surface 79 adapted to coact with a companion inner tapered surface 80 on the anchor portion 77 of the slips.

Outward expansion of the slip 62 under the influence of the springs 76 is limited by a retainer ring 81 encompassing the central portions of the slips and received within external grooves 82 therewithin. Outward movement is also limited by engagement of lower terminals 83 of the slips, below the drag portions 75, with an upper rim 84 of the orienting pin housing 302 surrounding the body 10 of the tool. The orienting pin housing 302 and the slip sleeve 73 are secured together by means of the orienting pin 301 so that they move as a unit.

The slips 62 are positioned above a setting means 300 which has the orienting pin 301 secured by threads 302 into a rotation bearing 306, the orienting pin 301 being received within a pin bore 303 of the bearing 306.

The orienting pin housing 302 is secured by means of threads 304 to a drag block retainer 305 therebelow. The drag block retainer 305 receives a rotation sleeve 307 containing the setting pin 317 protruding inwardly of the drag block retainer 305 within a pin bore 308 of the sleeve 307. The drag block retainer 305 also houses a drag block 400 frictionally engaging the inner wall of the casing liner C-1 at the lowermost end of the tool for resistance of longitudinal movement relative to the liner C-1 and urged outwardly by means of a plurality of spring members 401 within a receptacle 402. The lowermost end of the drag block retainer 305 is secured by threads 404 to a lower retainer 403.

The connector sleeve 69 carries around its exterior a snap ring 224 which is initially carried on a shoulder 225 of the orienting pin housing 302, such that the connector sleeve 69 and orienting pin housing 302 are interengaged, during run-in.

Figure 4:
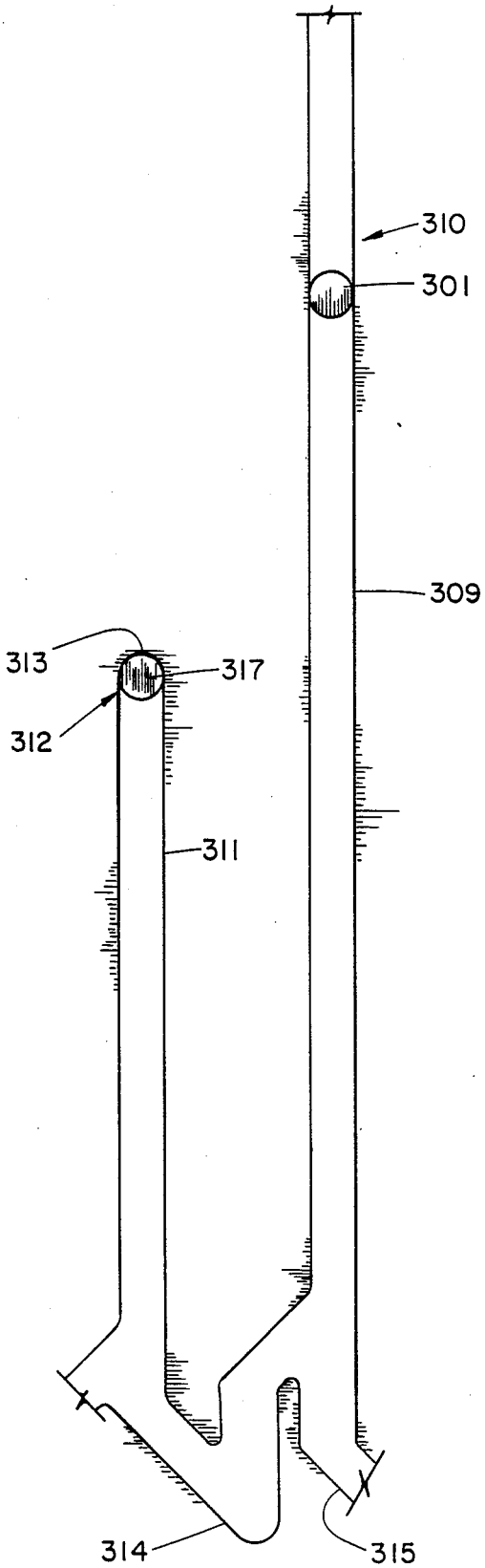
FIG. 4 is a flat planar view of the pin and slot configuration used in the packer manipulating procedure, shown in position during run-in of the tool into the well.
Figure 5:
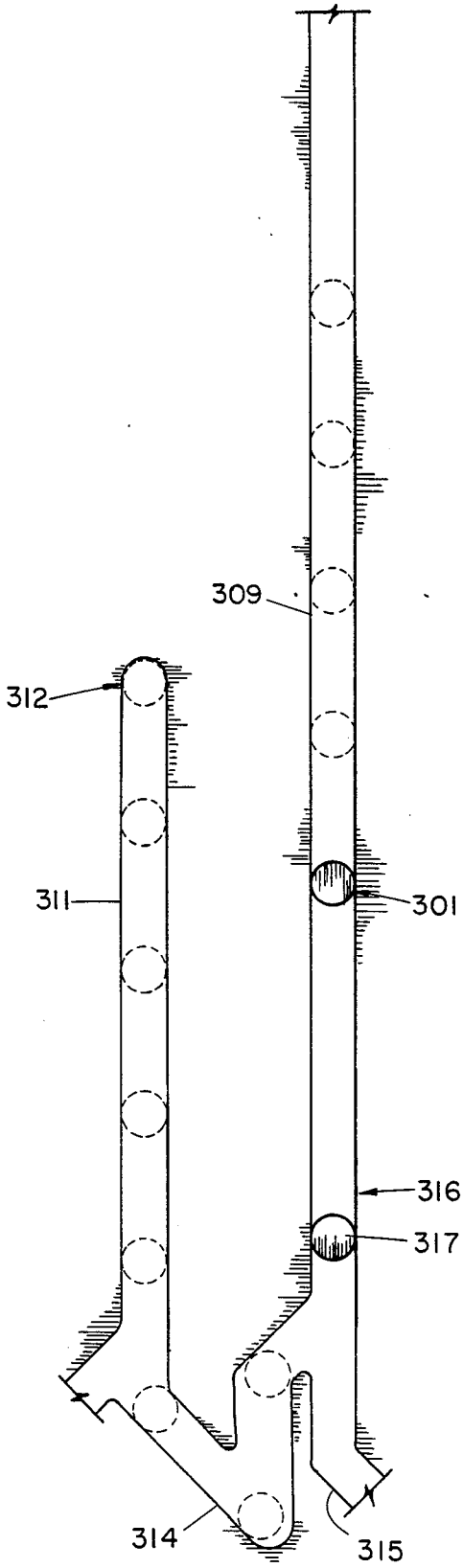
FIG. 5 is a view similar to that of FIG. 4 showing the pin and slot configuration as the packer mechanism is in the set position.

Now with reference to FIGS. 4 and 5, the setting means 300 has its orienting pin 301 in orienting position 310 on orienting slot 309. The pin 301 is in the orienting position 310 during run-in of the well packer RP and moves, from the position 310 (FIG. 4) to the setting position 316 (FIG. 5) within the orienting slot 309.

While the orienting pin 301 always remains within the orienting slot 309, such is not the case with the setting pin 317. The setting pin 317 is initially carried within the running slot 311 at the running position 312 on the upper end 313 of the running slot 311. When it is desired to set the well packer RP within the liner C-1, the workstring WS is picked up such that the slots 309 and 311 move up relative to the housing 302 and its interrelated parts. Accordingly, the orienting pin 301 will move from the orienting position 310 to the setting position 317 in the orienting slot 309 and the setting pin 317 will move from the upper end 313 of the running slot 311 to the slot curvature portion 314 bridging the lowermost end of the running slot 311 with the lowermost end of the orienting slot 309 to cause relative rotation between the mandrel 10 and the orienting pin housing 302 to place the setting pin 317 in the setting position 316 of the orienting slot 309. Now, the pins 301 and 317 are aligned such that there is no further resistance to longitudinal movement of the tubular workstring WS relative to the orienting pin housing 302 and its interrelated parts because of the movement of the setting pin 317 off of the upper end 313 of the running slot 311. Now, set down weight may be applied to the workstring WS to move the member 60 to engage the bevel 79 relative to the companion profile 80 on the slip assembly 77 to drive the wicker 78 into the inner wall of the liner section of casing C-1 to anchor the well packer apparatus RP to the wall of the liner C-1.

The slips 62 are prevented from having substantial longitudinal movement relative to the slip sleeve 73 by engagement of the lower ends 94 of the slips with the upper end of the orienting pin housing 302 by means of the inner engagement of the snap ring 224 on the shoulder 225 of the orienting pin housing 302 and also by engagement of the retainer ring 81 with an upper external flange 95 of the slip sleeve. The slips 62 are also held away from the expander or cone 61 by means of a retraction maintenance means 200 at the uppermost end of the tool. The retraction maintenance means 200 component parts operate in concert with the orientation, initially, of the snap ring 224 relative to the orienting pin housing 302 such that, until the well packer RP is transversely positioned interiorly of the liner C-1 below the enlarged diameter casing C-2, the well packer RP cannot be manipulated by longitudinal movement of the workstring WS to the set position.

The retraction maintenance means 200, being the uppermost end of the well packer RP, is secured at the threads 201 to the workstring WS, or other component tool associatively carried by the workstring WS, the threads 201 being on a top sub member 202 which, in turn, is secured by means of threads 223 to the member 10.

The top sub 202 carries a drag block 203 having an outer hardened surface 204 for smooth contact with the inner wall of the enlarged casing conduit C-2. The drag block 203 is spring biased outwardly by means of a plurality of spring members 208 housed within bores 207 with biasing ends contacting a profile 209 on the top sub 202 and the other end biasingly contacting the drag block housing 206. The housing 206 is secured at its uppermost end by means of threads 210 to an upper retainer 205 secured therearound and at its lower end by means of threads 212 to a lower retainer 211. A lock extension 213 extends downwardly of the housing 206 having a lock shoulder 214 thereon normally secured within an abutment 217 of a key member 216 carried at the uppermost end of a housing lock sleeve 215. The housing lock sleeve 215 has its lowermost end 218 abutting inwardly for coengagement with a top extension 220 of a housing sleeve 219 secured at threads 221 and set screw 222 to the valve head portion 37.

As long as the well packer RP is within the enlarged diameter regular casing C-2, the springs 208 will bias the housing 206 of the drag block 203 outwardly such that the outer surface 204 always engages the smooth interior wall of the casing C-2. This interengagement will keep the lock shoulder 214 of the lock extension 213 into secured engagement with the housing lock sleeve 215 by means of interengagement with the abutment 217 of the body 216. Therefore, when the retraction maintenance means 200 is in such position, and the snap ring 224 is in abutment with the shoulder 225 on the orienting pin housing 302, there can be no relative longitudinal movement between the member 10 and the packing assembly 55 and the cones 61 relative to the slips 77. However, when the device comes into engagement with the smaller diameter liner C-1, the springs 208 will be compressed, permitting the drag block 203 to contract. Such contraction will disengage the lock shoulder 214 relative to the abutment 217 such that the housing lock sleeve 215, housing sleeve 219, valve head portion 37, and all interrelated parts may be manipulated longitudinally relative to the mandrel 10 as the apparatus is reciprocated in response to relative longitudinal movement of the workstring WS to move the cones 61 into engagement with the slips 77 and to activate movement of the seal assembly 55 into sealing engagement with the interior wall of the casing liner C-1.

When the slip sleeve 73 is moved downwardly, its upper flange 95 engages the retainer ring 81, which engages the lower sides of the slip grooves 82 to pull the slip 62 downwardly in the well casing. When the slip sleeve 73 and the orienting pin housing 302 are moved upwardly, the upper end of the control member engages the lower ends 94 of the slips and shifts them upwardly along the wall of the well casing C-1.

The slips themselves are of the rocker type, in that the anchor portions 77 are removed from engagement with the wall of the well casing C-1 when the springs 76 are permitted to force the drag member 75 into full contact with the wall of the well casing C-1. However, when the expander 61 moves downwardly within and behind the anchor portion 77 of the slips, the latter will rock outwardly about the upper parts of the drag portion 75 as a fulcrum on the casing, to shift the teeth 78 outwardly against the well casing and embed them therewithin. The packer body or mandrel 10 moves downwardly with respect to the parts that surround it in order to engage the valve head 34 with its companion valve seat 36, to expand the packing structure 57 against the wall of the well casing C-1, and to engage the expander 61 with the anchor portion 77 of the slips and expand the latter outwardly into anchoring engagement with the wall of the well casing C-1. The ability of the body 10 of the tool to move in the manner just described is dependent upon the control mechanism provided between the slip mounting portions 73, 302 of the apparatus and the body 10 of the control tool 10, including the setting means 300.

OPERATION

When the well packer RP is disposed within the enlarged casing C-2, the retraction maintenance means 200 will be in "locked" position, such that the expansion of the packer 55 and the anchoring of the slips 77 cannot occur by longitudinal manipulation of the workstring WS at any time while the tool is in any conduit portion within the well W having an internal diameter larger than that for the casing liner C-1. In such position, the lock shoulder 214 is in locked abutting relationship to the abutment 217 of the key 216 and the snap ring 224 is secured within the shoulder 225 of the orienting pin housing 302. The orienting pin 301 is in the orienting position 310 of the orienting slot 309 and the setting pin 317 is shouldered on the upper end 313 of the running slot 311 at the running position 312. When the apparatus RP is moved by longitudinal movement of the workstring WS from the large diameter casing C-2 to the liner C-1 having a smaller internal diameter, the springs 208 are compressed and the drag block 203 contracts within the top sub 202 freeing the lock extension 213 from interengagement with the housing lock sleeve 215, and the lock shoulder 214 becomes disengaged from the abutment 217. Now, the well packer RP will be responsive to longitudinal manipulation of the workstring string WS to set the well packer RP.

At the desired location within the well and in, the liner C-1, when it is desired to set the well packer RP, the workstring will be picked up to align the setting pin 317 with the orienting pin 301 and move the setting pin 317 from within the running slot 311 and into the orienting slot 309. Accordingly, as the workstring WS is longitudinally manipulated and picked up, the mandrel 10 will move upwardly relative to the orienting pin housing 302 and the setting pin 317 will travel relatively down the running slot 311 to the slot curvature 314. It will be appreciated that the drag block 400 resists longitudinal movement of the orienting pin housing 302 relative to the mandrel 10, but rotation of the pins 317, 301 is permitted because they rotate within their respective rotation housings 307, 306. When the setting pin 317 is at the bottom of the slot curvature 314, further resistance to upward movement of the workstring WS will be detected at the top of the well, and the workstring WS may be set down, causing the mandrel 10 to move downwardly relative to the orienting pin housing 302 and shift the setting pin 317 from the running slot 311 into the orienting slot 309 to the setting position 316.

Figure 6A:
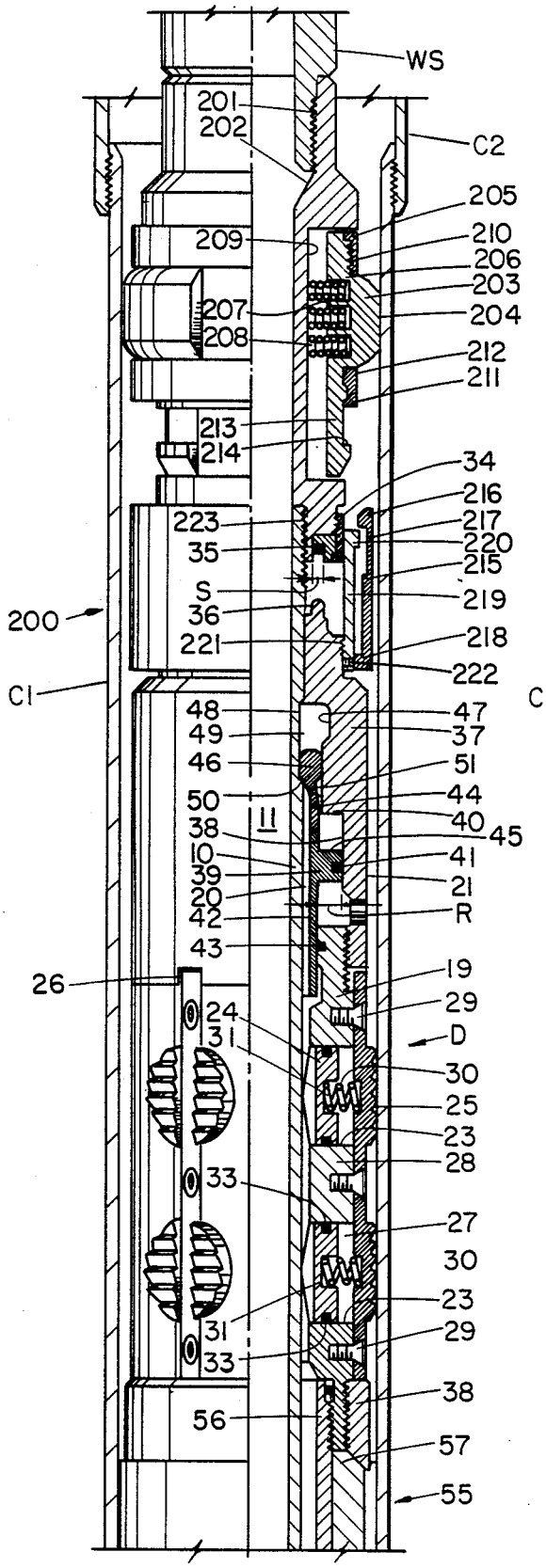
FIG. 6A and 6B are views similar to FIGS. 2A and 2B showing the tool anchored in packed-off condition in the well casing.
Figure 6B:
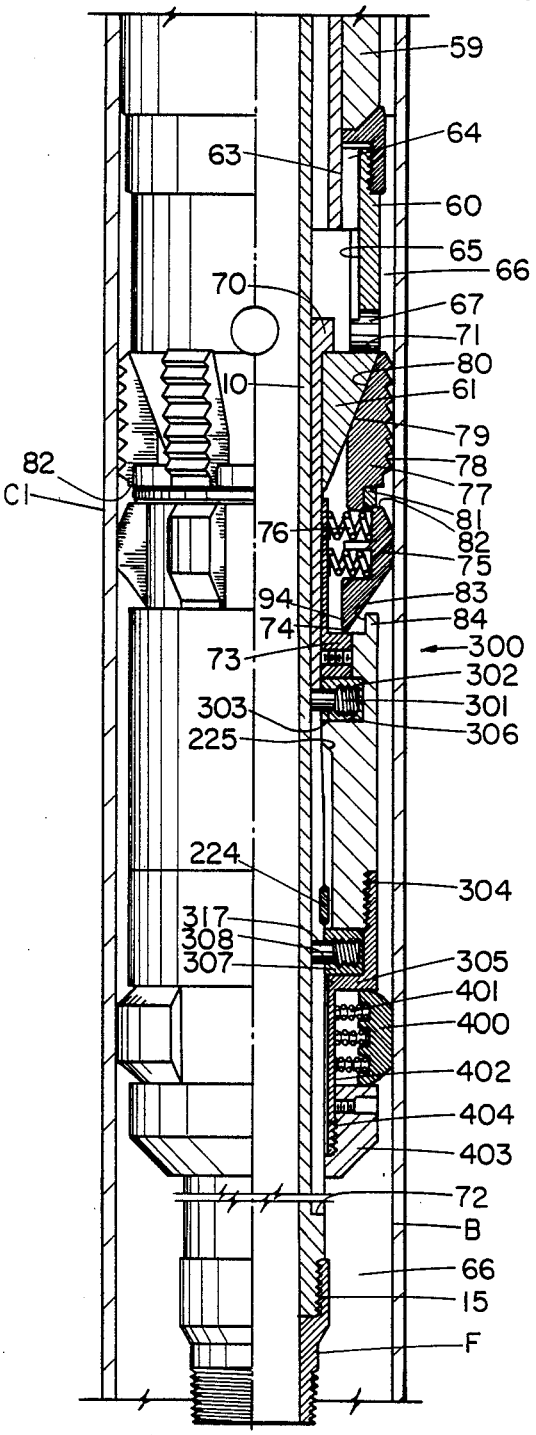
Figure 7:
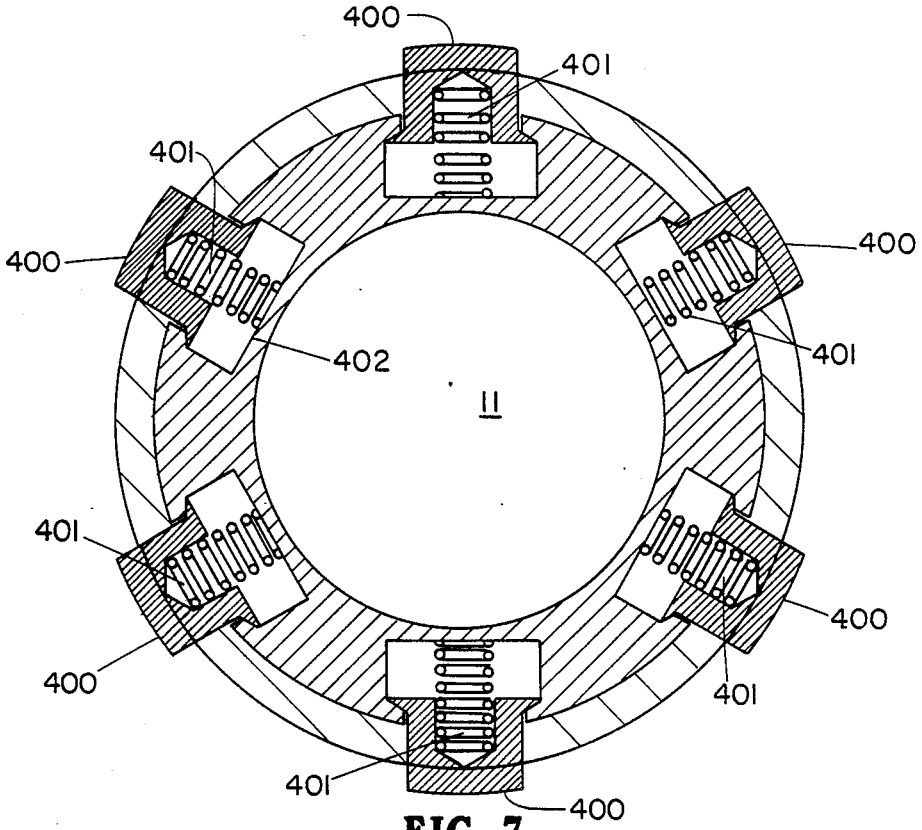
FIG. 7 is a sectional view taken along lines 7—7 of FIG. 2.
Figure 8:
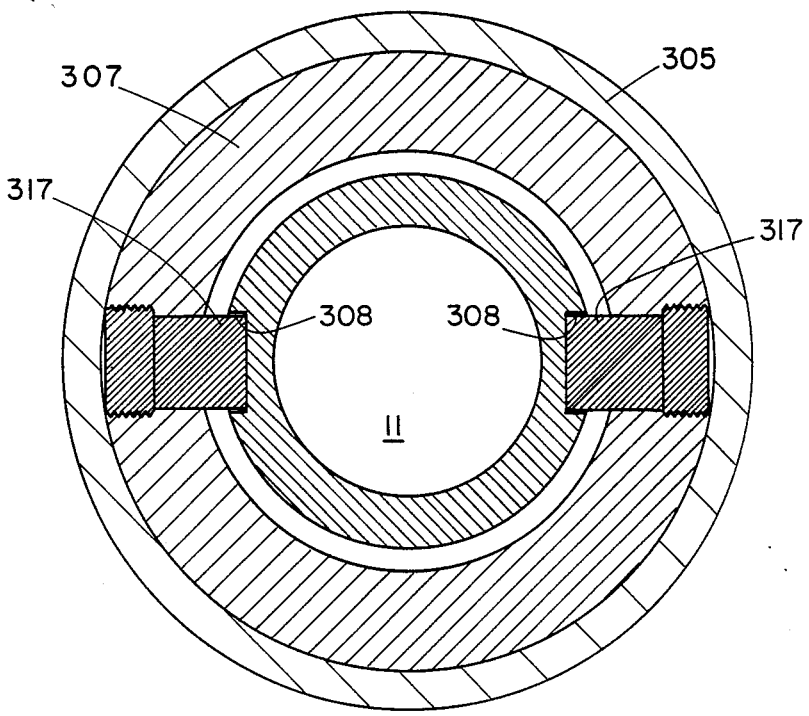
FIG. 8 is a sectional view taken along lines 8—8 of FIG. 2.
Figure 9:
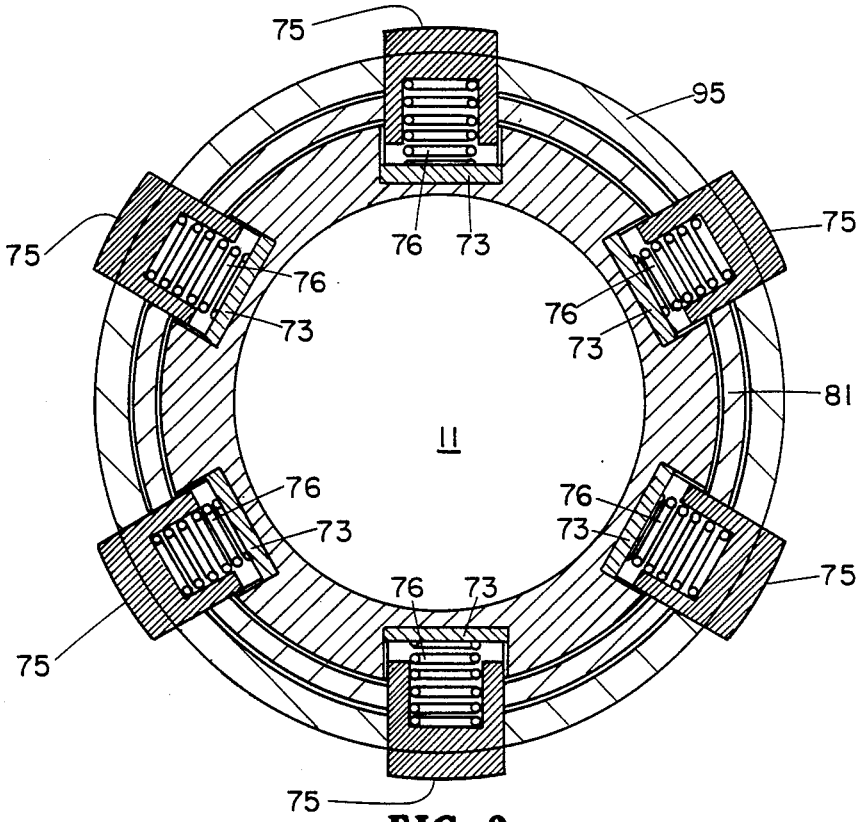
FIG. 9 is a sectional view taken along lines 9—9 of FIG. 2.
Figure 10:
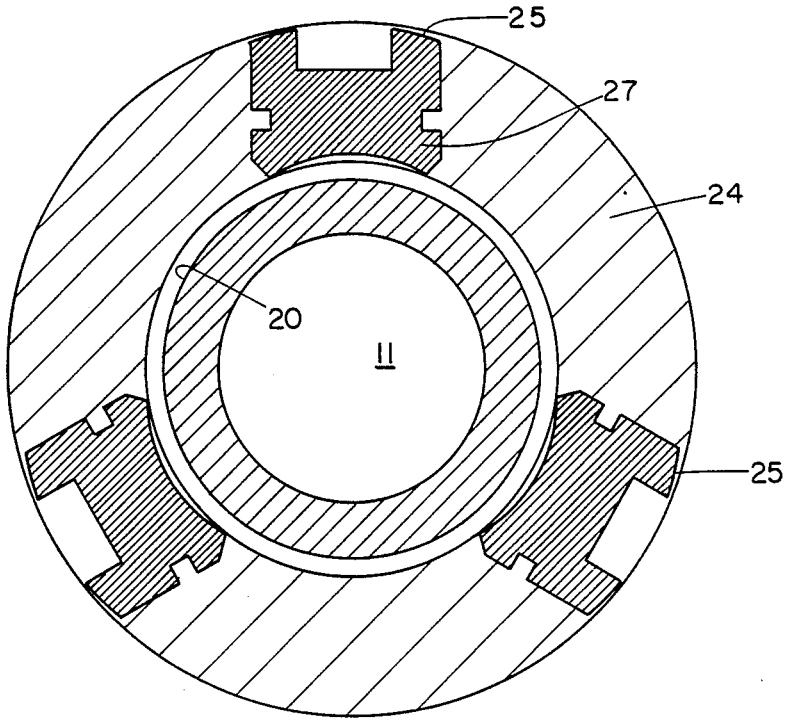
FIG. 10 is a sectional view taken along lines 10—10 of FIG. 2.
Figure 11:
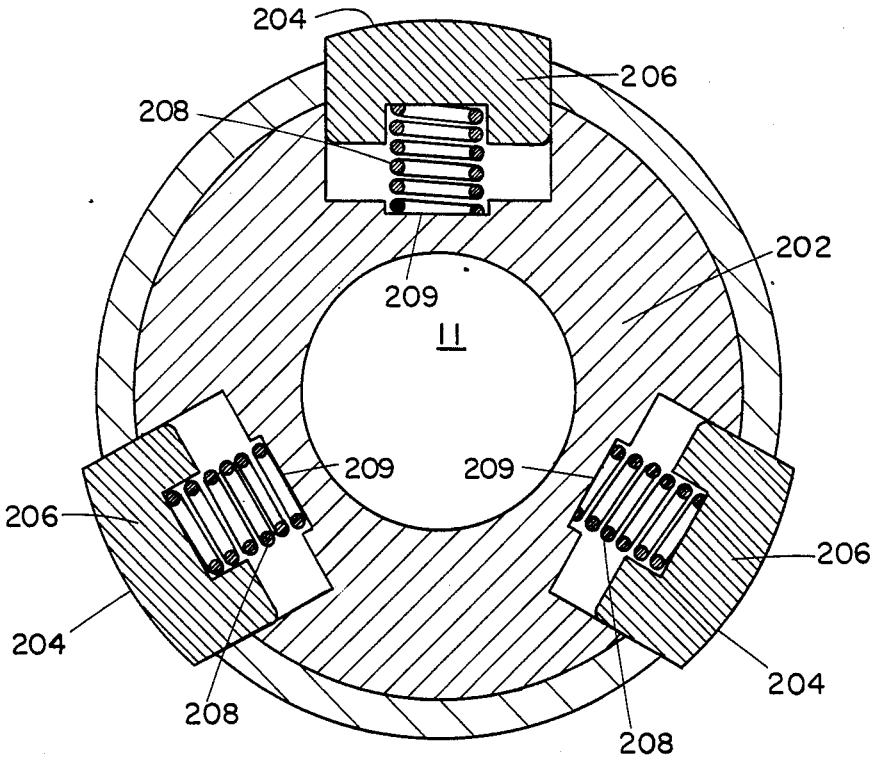
FIG. 11 is a sectional view taken along lines 11—11 of FIG. 2.

As downward movement of the body 10 occurs, the valve head 34 and seal ring 35 move downwardly into the cylindrical valve seat 36 to close the annular passage 20, the downward movement of the body 10 then moving the housing 21 and anchor body 19 and support sleeve 56 therewith, the packing structure 57 and the lower abutment 59 also being moved downwardly for the purpose of shifting the expander sleeve portion 60 and the expander 61 downwardly, accompanied by the connector sleeve 69. The expander 61 moves downward toward the slip 62, which are prevented from moving downwardly by engagement of their drag portion 75 with the wall of the well casing C-1. The connector sleeve 69 moves downwardly with the expander 61 and the body 10 and within the slip structure, the snap ring 224 camming the control pin 317 out of the way and allowing the snap ring to move pass the control pin 317 which will now slide upon the periphery of the connector sleeve. The downward movement of the body 10 and the parts surrounding it with the exception of the slip structure surrounding the connector sleeve 69, will now continue until the expander 61 moves within and behind the anchor portions 77 of the slips, shifting the latter outwardly into engagement with the wall of the well casing C-1. When this occurs, the expander 61 cannot move downwardly any further. Accordingly, the continued downward movement of the body 10 of the tool causes the anchor portion of the upper element 19, 58 to move toward the lower abutment 59, which is prevented from moving downwardly by being connected to the expander 61, compressing or shortening the packing sleeve 57 and expanding it outwardly into sealing engagement with the wall of the well casing liner C-1. The parts are now in the condition illustrated in FIGS. 6A and 6B.

As described above, upon downward movement of the body 10 within the anchor portion D and housing 21 of the tool, the peripheral groove 48 of the body is disposed opposite the latch fingers or heads 46, the latter snapping into such groove and out of the housing groove 47 whereupon the fingers or heads are adapted to bear against the lower shoulder 49 on the mandrel and then being disposed below the internal housing groove 47 and adapted to slide downwardly along the housing portion 51, at least to a small extent. The balance device 22 is now in condition to offset any pressure differentials in the apparatus, or therebelow, that would otherwise tend to shift the body or mandrel 10 upwardly and inadvertently open the valve and the annular passage 20 between the body 10 of the tool and the anchor portion D and the packing device 55.

A suitable operation can now be performed with the set packer RP. Thus, fluid under pressure is pumped down the tubular string WS and through the body or mandrel 10. Such fluid under pressure is also imposed on the fluid in the well bore below the set packing structure 55, passing through the port 67 and into the annulus 20 between the mandrel 10 and the anchor portion D and housing 21 connected to the anchor body. The fluid pressure acts on the gripping members 24 and urges them outwardly into gripping engagement with the wall of the well casing. In the event the apparatus is subjected to high pressure differentials, the anchoring action of the gripping members 24 against the well casing will prevent upward pumping or movement of the packer apparatus RP in the well casing C-1. At the same time, as has been noted above, such fluid pressure in the annulus 20 between the body or mandrel 10 and the housing 21 acts in a downward direction on the piston 39, the downward force being opposed through the latch heads 46 on the mandrel shoulder 49 urging the body or mandrel 10 in a downward direction and offsetting the tendency of the fluid pressure acting over the area S of the mandrel and tending to shift it in an upward direction.

After the operation in the well bore has been completed, the tool RP can be released from the well casing C-1 and removed therefrom, if desired. If the fluid pressure has been relieved, release will occur simply as the result of elevating the workstring WS and the body or mandrel 10 in the casing C-1. The expander 61 will move upwardly away from the slip 77 and the orienting pin 301 and setting pin 317 will travel downwardly within the orienting slot 309. The setting pin 317 will contact the lower end of the curvature 315 and will be pivoted into the running slot 311 and will be positioned on the upper end 313 of the slot 311 in the running position 312, with the orienting pin 301 replaced into the orienting position 310 in the orienting slot 309. Because the of the hydraulic counter-balance feature, the fluid pressure is substantially balanced on the body or mandrel 10, so that the latter can be shifted upwardly with exertion of comparatively little force on the workstring WS. At first, the body moves upwardly to carry the valve head 34 upwardly within the cylindrical valve seat 36, and also to carry the fingers or heads 46 upwardly with it until the latter or disposed opposite release groove 47 in the housing 21, whereupon the body or mandrel 10 will cam the latch heads or heads 46 outwardly free from the groove 48. The mandrel 10 can then shift upwardly to the extent required, the valve head and its seal moving out of the valve seat 36 in order to open the annular passage 20 around the mandrel 10 thereby enabling the fluid pressure to be equalized internally and externally of the apparatus. Following equalizing of the fluid pressure, the spring 30 shifts the piston gripping elements 34 to their retracted position free from engagement with the wall of the well casing liner C-1.

Figure 12A:
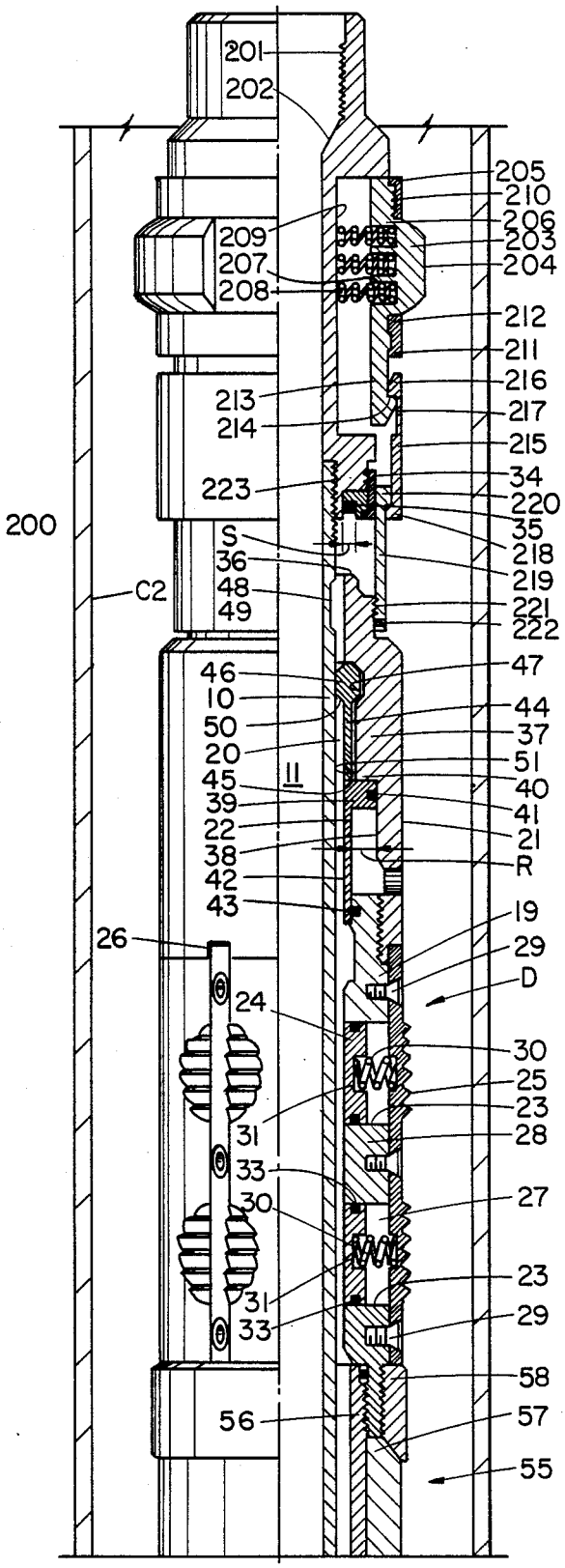
FIG. 12A and 12B are view corresponding to FIGS. 2A and 2B showing the tool after having been released from the well casing.
Figure 12B:
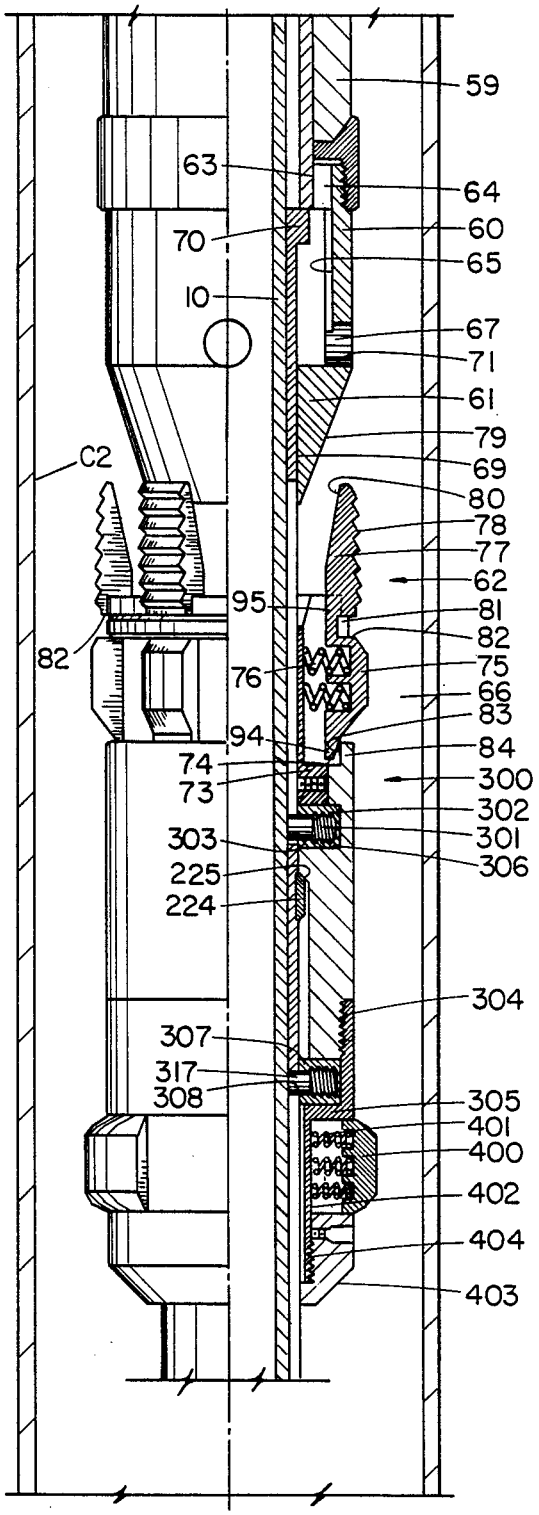

During the initial phase of upward movement of the mandrel 10, the upper end 72 of the mandrel 10 will carry the setting pin 317 on the upper end of 313 such that the setting pin 317 will contact the lowermost end of the connector sleeve 69 to move it upwardly such that the upper end 70 thereof engages the lower end of the support sleeve 56, whereupon the support sleeve and the anchor portion D connected thereto are shifted upwardly with the body 10, to move the upper abutment constituted by the anchor body 19 and gauge ring 58 away from the lower abutment 59 which will permit the packing sleeve 57 to retract to its initial position. The support sleeve 56 moves upwardly with the body 10 and the connector sleeve 69 until its lower flange 63 engages the lower abutment 59, which will then elevate the expander sleeve portion 60 and the expander 61 from the anchor portion 71 of the slip 62, allowing the spring 76 to rock the drag portion 75 of the slips back into full surface contact with the wall of the well casing C-1 and pivot the anchor portion 77 inwardly from engagement with the wall of the well casing C-1. The expander 61 can move upwardly of the slips until the orienting pin housing 302 engages the abutment on the member F by contact of the retainer 403 thereon. The parts are now in the position they occupy during elevation of the apparatus in the well casing C-1 which is illustrated in FIGS. 12A and 12B. During such elevating movement through fluid in the well casing C-1, the resistance of such fluid cannot inadvertently expand the piston gripping elements 24 and the packing structure 57 against the wall of the well casing C-1 since the fluid force is disposed internally of the gripping elements 24 as well as externally thereof and it is also prevented from acting on and moving the upper abutment or anchor body 19 relatively downwardly toward the lower abutment 59 which would effect a shortening of the packing structure 57 and its outward expansion.

It will also be appreciated that when the well packer A passes from within the liner casing C-2 to within the enlarged casing section C-1 as a result of further longitudinal pulling of the workstring WS, the retracting maintenance means 200 will be activated and the compressive bias within the springs 208 will be released to cause the drag block 203 to move outwardly of the to sub 202 such that the lock extension 213 becomes engaged with the housing lock sleeve 215 and the lock shoulder 214 comes into abutment contact with the abutment 217 of the key 216. Now, there can be no inadvertent setting of the well packer A as it is retrieved to the top of the well.

While the drawings show a threaded connection between casing members C-2, C-1, such is for illustration only, since those skilled in the art will appreciate that such connection is achieved by means of a liner hanger device, the construction details of which extend far beyond the scope of this invention. The hanger is not part of the present invention.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A packer assembly for use in a subterranean well and settable in said well only by longitudinal manipulation of a tubular workstring, comprising:

(1) an outer housing;

(2) a seal assembly and anchoring means carried by said housing in initial retracted position and movable to expanded position for engagement along the inner wall of a tubular conduit disposed within said well;

(3) a longitudinally extending control mandrel telescopically movable within said housing, at least one of said housing and said control mandrel operably extending from said workstring;

(4) orienting and setting pins carried on one of said housing and said control mandrel;

(5) orienting slot means having a first length and running slot means having a second length shorter than said first length, each of the slot means being defined on the other of said housing and said control mandrel for receipt of said orienting and setting pins, respectively; and (6) means for manipulating said housing relative to said mandrel to a first position to orient said pins and said slot means whereby said orienting pins are within said orienting slot means and said setting pins are within said running slot means to place said seal assembly and said anchoring means in retracted position, and to a second position whereby said orienting and setting pins are within said orienting slot means to place said seal assembly and said anchoring means in expanded position.

2. The packer assembly of claim 1 wherein said orienting and setting pins are carried on said housing and said slot means are defined on said control mandrel.

3. The apparatus of claim 1 wherein said orienting and setting pins are positioned to freely rotate on one of said housing and said control mandrel.

4. The assembly of claim 1 wherein said anchoring means comprises slip and cone elements, said cone elements being longitudinally positioned away from said slip elements when said setting pins are within said running slot means.

5. The assembly of claim 1 wherein said anchoring means comprises slip and cone elements, said cone elements being longitudinally positioned away from said slip elements when said setting pins are within said running slot means, said cone means being slidable under said slip means to expand same into engagement along the inner wall of the tubular conduit when said setting pins are within said orienting slot means.

6. The assembly of claim 1 wherein said means for manipulating said housing relative to said mandrel comprises said tubular workstring.

7. A method for setting a packer assembly within a subterranean well only by longitudinal manipulation of a tubular workstring, comprising the steps of:

(a) securing to said tubular workstring at the top of said well a packer assembly comprising:

(1) an outer housing;

(2) a seal assembly and anchoring means carried by said housing in initial retracted position and movable to expanded position for engagement along the inner wall of a tubular conduit disposed within said well;

(3) a longitudinally extending control mandrel telescopically movable within said housing, at least one of said housing and said control mandrel operably extending from said workstring;

(4) orienting and setting pins carried on one of said housing and said control mandrel;

(5) orienting slot means having a first length and running slot means having a second length shorter than said first length, each of the slot means being defined on the other of said housing and said control mandrel for receipt of said orienting and setting pins, respectively; and (6) means for manipulating said housing relative to said mandrel to a first position to orient said pins and said slot means whereby said orienting pins are within said orienting slot means and said setting pins are within said running slot means to place said seal assembly and said anchoring means in retracted position, and to a second position whereby said orienting and setting pins are within said orienting slot means to place said seal assembly and said anchoring means in expanded position;

(b) running said packer assembly within said well on said tubular workstring and positioning said packer assembly above a production zone;

(c) longitudinally manipulating said tubular workstring in a first direction to move said setting pins from said running slot means to said orienting slot means; and (d) longitudinally manipulating said tubular workstring in the opposite direction to move said seal assembly and said anchoring means from retracted position to expanded position to engage said seal assembly and said anchoring means along the inner wall of said tubular conduit disposed within said well.

8. The method of claim 7 wherein said orienting and setting pins are carried on said housing and said slot means are defined on said control mandrel.

9. The method of claim 7 wherein said orienting and setting pins are positioned to freely rotate on one of said housing and said control mandrel.

10. The method of claim 7 wherein said anchoring means comprises slip and cone elements, said cone elements being longitudinally positioned away from said slip elements when said setting pins are within said running slot means.

11. The method of claim 7 wherein said anchoring means comprises slip and cone elements, said cone elements being longitudinally positioned away from said slip elements when said setting pins are within said running slot means, said cone means being slidable under said slip means to expand same into engagement along the inner wall of the tubular conduit when said setting pins are within said orienting slot means.

12. The method of claim 7 wherein said means for manipulating said housing relative to said mandrel comprises said tubular workstring.

13. A packer for seating within a subterranean well and introduceable within said well through a first tubular conduit having a first internal diameter and communicating with a second tubular conduit therebelow having a second internal diameter less than that of said first tubular conduit, said packer being activatable to sealing position in said well only when said assembly is within said second tubular conduit, comprising:

(1) an outer housing;

(2) a seal assembly and anchoring means carried by said housing in initial retracted position when said packer is within said first tubular conduit and movable to expanded position only when said packer is within said second tubular conduit to seal within the second tubular conduit;

(3) means for manipulating said seal assembly and said anchoring means between retracted and expanded positions; and (4) means for maintaining said seal assembly and said anchoring means in retracted position and responsive to the variation in internal diameters between the first and second tubular conduits to thereafter permit said means for manipulating to move said seal assembly and said anchoring means to expanded position within only said second tubular conduit, said means for maintaining said seal assembly and said anchoring means in retracted position comprising means initially securing said housing to said means for manipulating said seal assembly and said anchoring means; and (5) locking means including first and second sleeve means extending between said housing and said means for manipulating said seal assembly and said anchoring means and carried on said outer housing, said locking means further including ring means between said housing and said means for manipulating said seal assembly and said anchoring means and positioned below said anchoring means, said locking means held in interengaged condition when said packer is within said first tubular conduit and activatable to disengaged condition when said packer is within said second tubular conduit.

14. The packer of claim 13 wherein said means for maintaining said seal assembly and said anchoring means in retracted position comprises means initially securing said housing to said means for manipulating said seal assembly and said anchoring means and first and second locking means extending between said housing and said means for manipulating said seal assembly and said anchoring means and held in interengaged condition when said packer is within said first tubular conduit and activatable to disengaged condition when said packer is within said second tubular conduit, and further comprising means in communication with said first locking means and biased to an expanded position while said packer is in said first tubular conduit and moved to a retracted position in response to the internal diameter of the second tubular conduit to disengage said first locking means from said second locking means.

15. The packer of claim 14 wherein said means for maintaining said seal assembly and said anchoring means in retracted position and responsive to the variation in internal diameter between the first and second tubular conduits comprises drag means exteriorly disposed around said housing and movable from a first position when said packer is in said first tubular conduit to a second position when said packer is in said second tubular conduit to disengage said first locking means from said second locking means.

16. A method for seating a packer within a subterranean well and introduceable within said well through a first tubular conduit having a first internal diameter and communicating with a second tubular conduit therebelow having a second internal diameter less than that of the first tubular conduit, comprising the steps of:

(a) Assembling at the top of the well on a tubular workstring, a packer having:

(1) an outer housing;

(2) a seal assembly and anchoring means carried by said housing in initial retracted position when said packer is within said first tubular conduit and movable to expanded position only when said packer is within said second tubular conduit to seal within the second tubular conduit;

(3) means for manipulating said seal assembly and said anchoring means between retracted and expanded positions; and (4) means for maintaining said seal assembly and said anchoring means in retracted position and responsive to the variation in internal diameters between the first and second tubular conduits to thereafter permit said means for manipulating to move said seal assembly and said anchoring means to expanded position within only said second tubular conduit, said means for maintaining said seal assembly and said anchoring means in retracted position comprising means initially securing said housing to said means for manipulating said seal assembly in said anchoring means; and (5) locking means including first and second sleeve means extending between said housing and said means for manipulating said seal assembly and said anchoring means and carried on said outer housing, said locking means further including ring means between said housing and said means for manipulating said seal assembly and said anchoring means and positioned below said anchoring means, said locking means held in interengaged condition when said packer is within said first tubular conduit and activatable to disengaged condition when said packer is within said second tubular conduit.

17. The packer of claim 16 wherein said means for maintaining said seal assembly and said anchoring means in retracted position comprises means initially securing said housing to said means for manipulating said seal assembly in said anchoring means and first and second locking means extending between said housing and said means for manipulating said seal assembly and said anchoring means and held in interengaged condition when said packer is within said first tubular conduit and activatable to disengaged condition when said packer is within said second tubular conduit, and further comprising means in communication with said first locking means and biased to an expanded position while said packer is in said first tubular conduit and moved to a retracted position by the internal diameter of the second tubular conduit to disengage said first locking means from said second locking means.

18. The packer of claim 17 wherein said means for maintaining said seal assembly and said anchoring means in retracted position and responsive to the variation in internal diameter between the first and second tubular conduits comprises drag means exteriorly disposed around said housing and movable from a first position when said packer is in said first tubular conduit to a second position when said packer is in said second tubular conduit to disengage said first locking means from said second locking means.

19. A packer for seating within a subterranean well and introduceable within said well through a first tubular conduit having a first internal diameter and communicating with a second tubular conduit therebelow having a second internal diameter less than that of said first tubular conduit, said packer being activatable to sealing position in said well only when said assembly is within said second tubular conduit, comprising:

(1) an outer housing;

(2) a seal assembly and anchoring means carried by said housing in initial retracted position and movable to expanded position for engagement along the inner wall of a tubular conduit disposed within said well;

(3) a longitudinally extending control mandrel telescopically movable within said housing, at least one of said housing and said control mandrel operably extending from said workstring;

(4) orienting and setting pins carried on one housing and said control mandrel;

(5) orienting slot means having a first length and running slot means having a second length shorter than said first length, each of the slot means being defined on the other of said housing and said control mandrel for receipt of said orienting and setting pins, respectively;

(6) means for manipulating said housing relative to said mandrel to a first position to orient said pins and said slot means whereby said orienting pins are within said orienting slot means and said setting pins are within said running slot means to place said seal assembly and said anchoring means in retracted position, and to a second position whereby said orienting and setting pins are within said orienting slot means to place said seal assembly and said anchoring means in expanded position; and (7) means for maintaining said seal assembly and said anchoring means in retracted position and responsive to the variation in internal diameters between the first and second tubular conduits to thereafter permit said means for manipulating said housing relative to said mandrel to move said seal assembly and said anchoring means to expanded position within only said second tubular conduit.

20. The packer assembly of claim 19 wherein said orienting and setting pins are carried on said housing and said slot means are defined on said control mandrel.

21. The apparatus of claim 19 wherein said orienting and setting pins are positioned to freely rotate on one of said housing and said control mandrel.

22. The assembly of claim 19 wherein said anchoring means comprises slip and cone elements, said cone elements being longitudinally positioned away from said slip elements when said setting pins are within said running slot means.

23. The assembly of claim 19 wherein said anchoring means comprises slip and cone elements, said cone elements being longitudinally positioned away from said slip elements when said setting pins are within said running slot means, said cone means being slidable under said slip means to expand same into engagement along the inner wall of the tubular conduit when said setting pins are within said orienting slot means.

24. The assembly of claim 19 wherein said means for manipulating said housing relative to said mandrel comprises said tubular workstring.

25. The packer of claim 19 wherein said means for maintaining said seal assembly and said anchoring means in retracted position comprises means initially securing said housing to said means for manipulating said seal assembly in said anchoring means and first and second locking means extending between said housing and said means for manipulating said seal assembly and said anchoring means and held in interengaged condition when said packer is within said first tubular conduit and activatable to disengaged condition when said packer is within said second tubular conduit.

26. The packer of claim 19 wherein said means for maintaining said seal assembly and said anchoring means in retracted position comprises means initially securing said housing to said means for manipulating said seal assembly and said anchoring means and first and second locking means extending between said housing and said means for manipulating said seal assembly and said anchoring means and held in interengaged condition when said packer is within said first tubular conduit and activatable to disengaged condition when said packer is within said second tubular conduit, and further comprising means in communication with said first locking means and biased to an expanded position while said packer is in said first tubular conduit and moved to a retracted position by the internal diameter of the second tubular conduit to disengage said first lock means from said second lock means.

27. The packer of claim 25 or claim 26 wherein said means for maintaining said seal assembly and said anchoring means in retracted position and responsive to the variation in internal diameter between the first and second tubular conduits comprises drag means exteriorly disposed around said housing and movable from a first position when said packer is in said first tubular conduit to a second position when said packer is in said second tubular conduit to disengage said first locking means from said second locking means.

28. The packer of claim 19 wherein said anchoring means comprises slip and cone elements, said cone elements being longitudinally positioned away from said slip elements when said packer is in said first tubular conduit, said cone elements being longitudinally movable for implacement interiorly of said slip elements to move said slip elements into expanded position only when said packer is within said second tubular conduit.

* * * * *